United States Patent [19]

Broderick

[11] 3,954,034

[45] May 4, 1976

[54] ROTARY CUTTING MECHANISM

[75] Inventor: Frank William Broderick, New Providence, N.J.

[73] Assignee: Standex International Corporation, Andover, Mass.

[22] Filed: Apr. 25, 1974

[21] Appl. No.: 464,009

[52] U.S. Cl. ..... 83/117; 83/346; 83/659; 83/678

[51] Int. Cl.[2] ..... B26D 1/40

[58] Field of Search ..... 83/117, 116, 346, 347, 83/430, 678, 659

[56] References Cited

UNITED STATES PATENTS

| | | | |
|---|---|---|---|
| 628,466 | 7/1899 | Houghtlin | 83/659 X |
| 1,601,335 | 9/1926 | Addison | 83/659 |
| 2,299,650 | 10/1942 | Parks, Jr. et al. | 83/305 |
| 2,469,526 | 5/1949 | Sloat | 83/347 X |
| 3,162,076 | 12/1964 | Emerson et al. | 83/347 X |
| 3,495,487 | 2/1970 | Miner | 83/678 X |
| 3,526,163 | 9/1970 | Lowery | 83/116 X |
| 3,528,334 | 9/1970 | Geschwender | 83/678 X |
| 3,552,244 | 1/1971 | Smith, Jr. | 83/116 X |
| 3,823,633 | 7/1974 | Ross | 83/346 |
| R2,393 | 11/1866 | Gale | 83/346 X |

*Primary Examiner*—Frank T. Yost
*Attorney, Agent, or Firm*—Weingarten, Maxham & Schurgin

[57] ABSTRACT

A rotary cutting mechanism for the accurate, repetitive, controlled, pattern spacing of slits in thin flexible sheet material. The mechanism comprises a pair of rolls with one of the rolls having a plurality of blades spaced at intervals about its circumference. Each blade contains a plurality of cutting edges. The other roll has a plurality of platen bars spaced in a manner to cooperate with each cutting edge. Both of the rolls have steel bearers mounted at their ends with the bearers on the rolls having the same diameter as the outer edges of the cutting edges and of the platen bars to precisely control the cutting action of the mechanism.

2 Claims, 7 Drawing Figures

ROTARY CUTTING MECHANISM

Figure 1:
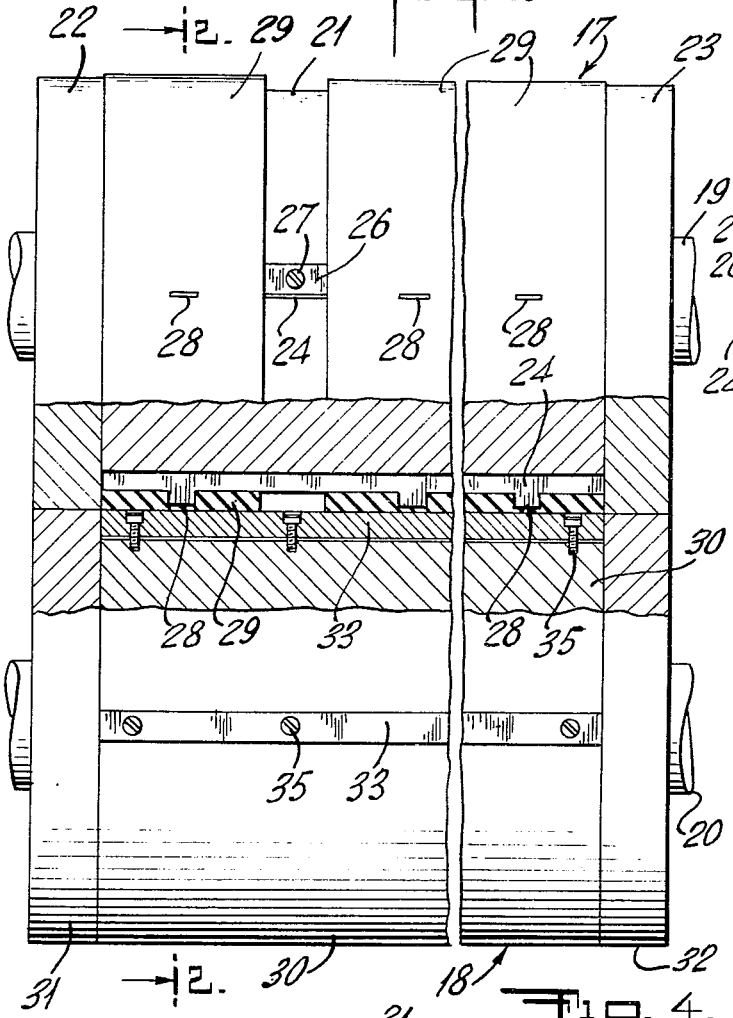

The present invention is directed to a rotary cutting mechanism and more particularly to a rotary cutting mechanism for specific use in the register pattern cutting of thin flexible sheet material.

Rotary cutting mechanisms are known in the art. High speed mechanisms which have a plurality of intermittent cutting blades on one roll which operate in combination with intermittent platen bars or impression bars on a cooperating roll are shown and described in many patents, for example, see U.S. Pat. No. 2,299,650 to J. A. Parks, Jr. et al. In many instances as for example in the previously mentioned patent steel bearing members are used to control the spacing of the cutting edge and the platen bar.

I have now discovered a new and improved rotary cutting mechanism which is especially suitable for the cutting or intermittent slitting of thin, light-weight, flexible materials such as paper, film, and the like.

My new and improved mechanism is especially adapted to be used for the cutting or slitting of thin flexible materials which have been previously printed and/or embossed and require an exact, accurate, register slitting for various purposes such as for actuating and/or indexing slitting and cutting equipment, wrapping and packaging equipment and the like. A specific example of the operations discussed above would be on a wide sheet of paper which has been multi-colored printed with a plurality of labels. The sheet may have ten, twenty, thirty or more labels running across the width of the sheet. To facilitate the automatic cutting and wrapping of packages utilizing these labels, there must be some means on each label to actuate the automated machinery. The sheet may be cut into strips of one label width and each label notched by a machine. The notch then acts as an indices to automate subsequent packing and wrapping machinery.

I have developed a machine wherein the full width sheet is passed through the machine, and a cut or slit, which will act as an index and actuator in future operations, accurately placed in each label in the full width sheet.

In accordance with the present invention, my new and improved rotary cutting mechanism comprises a pair of rolls having the same diameter and mounted with their axes parallel. One of the rolls has a plurality of bars mounted at spaced intervals about the periphery of the roll. The bars are mounted parallel to the axis of the roll and each bar has a plurality of cutting edges spaced along its length equidistantly apart. Resilient material is mounted on the surface of the roll and extends between cutting edges on adjacent bars and surrounds each cutting edge. The second roll has a plurality of anvils or platens mounted at spaced apart intervals about the periphery of the roll and running the length of the roll. The anvils are mounted parallel to the axis of the roll. The anvils are adjustably and removably mounted and are spaced so that on rotation of the rolls, the anvils and the cutting edges meet at the closest point between the two rolls. Both of the rolls have steel bearer members mounted at each end of the roll and rotating therewith. The steel bearing members on the first roll have a diameter equal to the diameter of the roll as measured at the outer edge of the cutting edges and the steel bearing members on the second roll have a diameter equal to the diameter of the roll as measured at the outer surfaces of the anvils.

Thin flexible sheet material as it passes between the pair of rolls to be slit in the pattern of the cutting edges moves smoothly and at very high speeds through the rolls. The resilient material between cutting edges prevents the flapping or vibration of the material so as not to disrupt the accurate pattern of slits to be placed in the material. In the high speed rotary cutting of thin sheet material where the cutting is accomplished in an intermittent pattern there is considerable tendency for the material to wave or flex between those areas where it is being held and actually cut. The wider the spacing between areas to be cut and the faster the operation, the more waving there is. This waving disrupts the accuracy of the spacing between cuts and when the cuts are used as indexing means for automated machinery even minute changes in the spacing may radically disrupt the subsequent automated machinery. The use of resilient material between edges holds the material in place during the cutting operation. The resiliency of the material in no way affects the placing of the slit or cut in he thin sheet.

Figure 2:
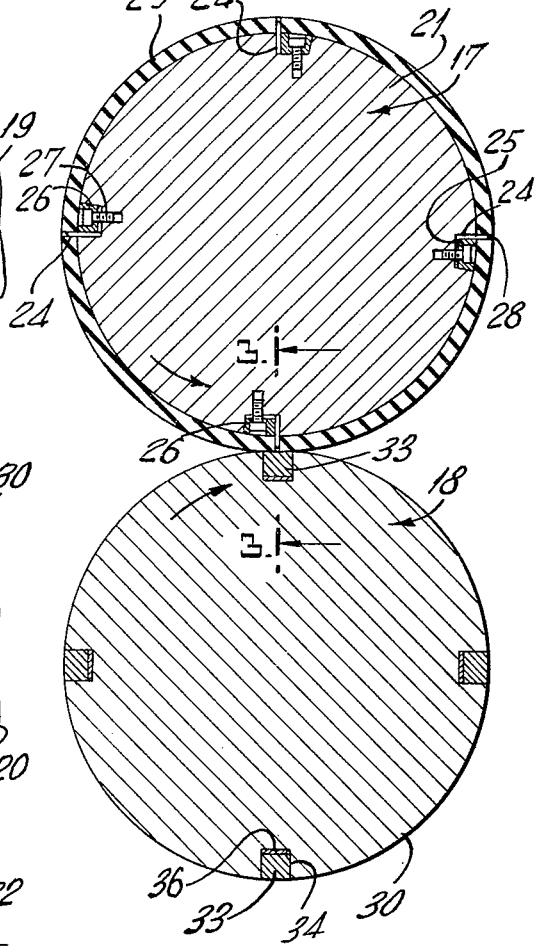
Figure 4:
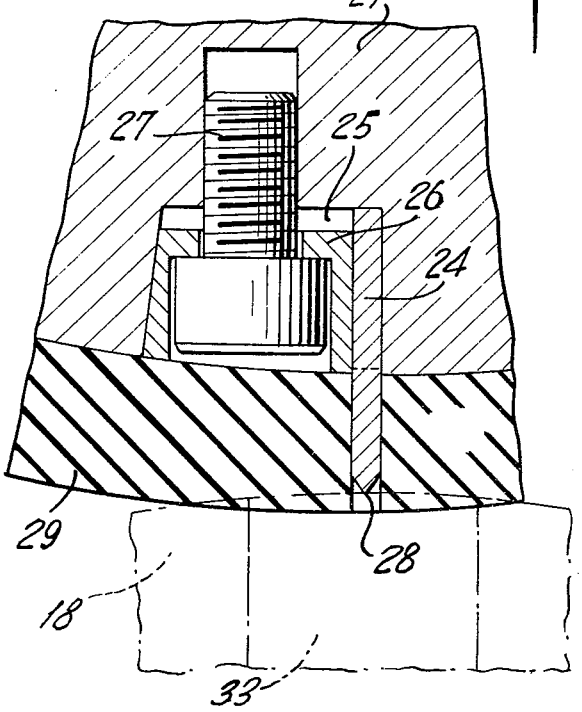
Figure 5:
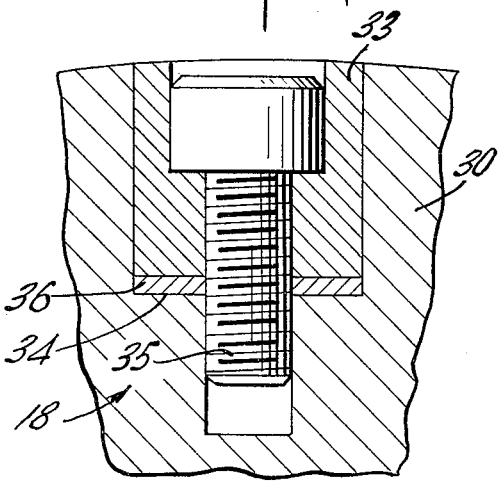
Figure 5:
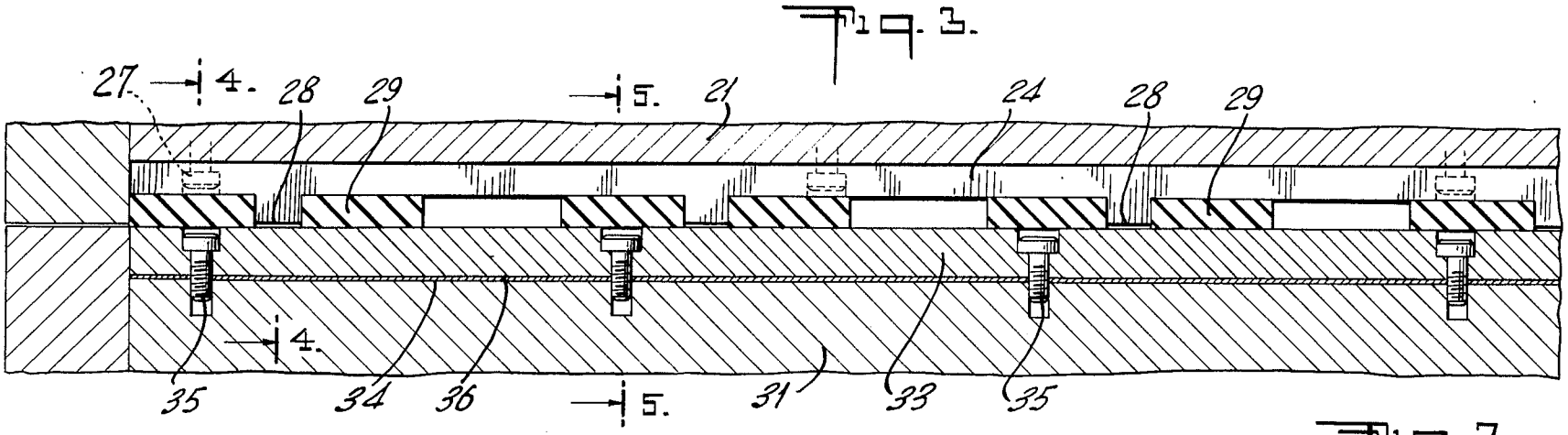
Figure 7:
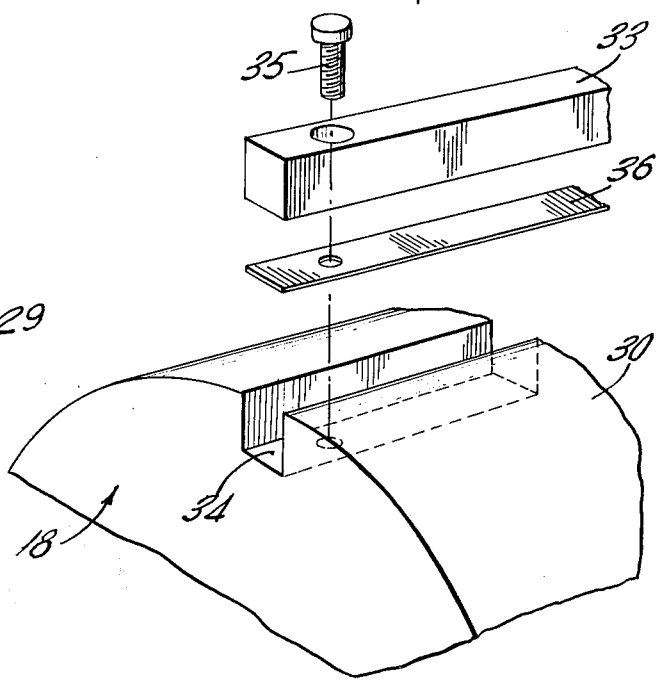
Figure 6:
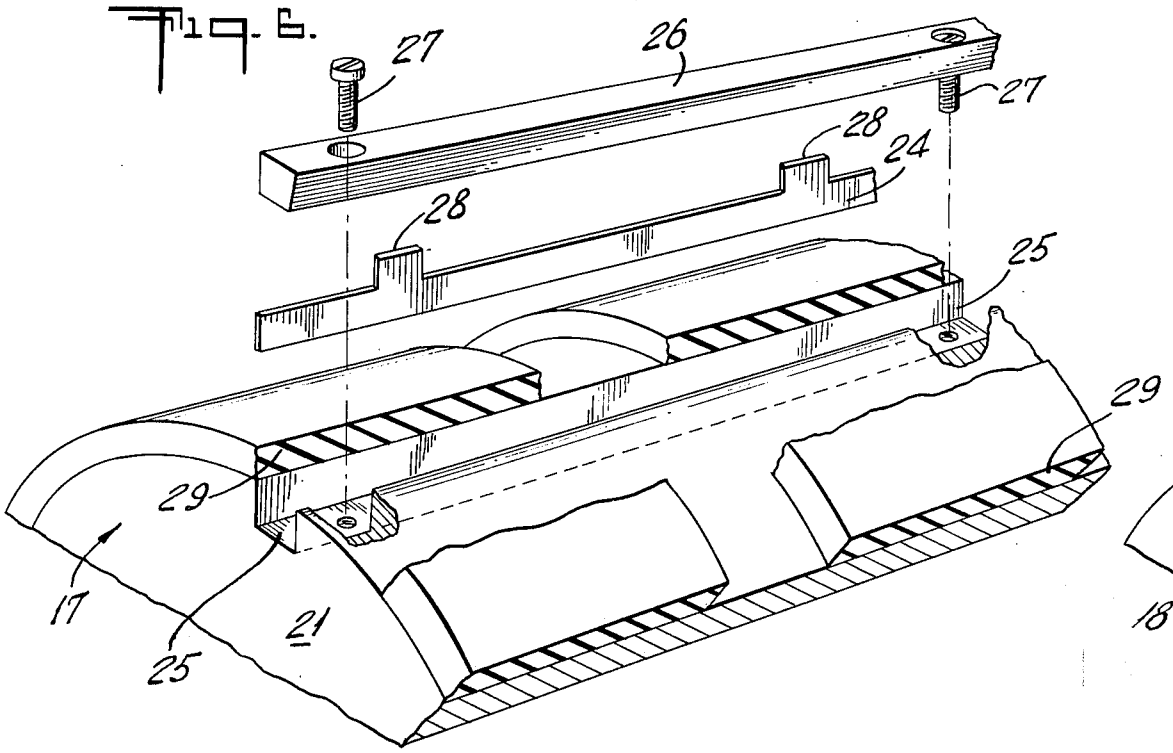

The invention will be more fully described in conjunction with the accompanying drawings wherein:

FIG. 1 is a sectional front view of the rotary cutting mechanism of the present invention, FIG. 2 is a cross-sectional view taken along line 2—2 of FIG. 1, FIG. 3 is an enlarged sectional view taken along line 3—3 of FIG. 2, FIG. 4 is an enlarged sectional view taken along line 4—4 of FIG. 3, FIG. 5 is an enlarged sectional unit taken along line 5—5 of FIG. 3, FIG. 6 is an exploded view showing the positioning of one blade in the roll, and FIG. 7 is an exploded view showing the positioning of one anvil in the other roll.

Referring to FIGS. 1 and 2 of the drawings, there is shown a top roll 17 and a bottom roll 18. The top roll is keyed on a shaft 19 suitably mounted for rotation in bearings mounted in a suitable frame. The bottom roll is also keyed on a shaft 20 suitably mounted for rotation in bearings mounted in framing. As the bearings and framing are well-known and standard in the art, they have not been shown in the drawings for the sake of clarity.

The top roll has a center portion 21 and at each end of this portion, there is a steel bearer 22 and 23. The steel bearer portions have a slightly larger diameter than the center portion of the roll. Mounted on the outside circumference of the roll and running parallel to the axis of the roll are a plurality of blades 24. As is more clearly seen in FIG. 6, the blade 24 is mounted in a slot 25 in the surface of the roll 17 and is held in this slot by a wedge shaped member 26 and suitable screws 27. The screws may be removed and the wedge shaped member removed for easy removal and replacement of the blade and its cutting edge 28. The outer edge of the blade has a plurality of outwardly extended cutting edge portions 28 spaced along the blade.

Wrapped about the circumference of the roll and extending between cutting edges of adjacent blades is sponge rubber or other suitably resilient material strips 29. The diameter of the steel bearers 22 and 23 and the diameter measured across the very outer cutting edge surface is the same.

The bottom roll 18 comprises a center portion 30 with steel bearers 31 and 32 at each end of the center portion. The steel bearers have a slightly larger diameter than the center portion of the roll. On both rolls, the bearers are keyed to the center portion of the roll so that the bearers rotate with the center portion.

Mounted in slots 34 on the outer circumference of the center portion 30 of the roll are a plurality of anvil or platen bars 33. The bars run between bearers and are parallel to the axis of the roll. As is more clearly seen in FIG. 7, the platen bars are held to the center portion of the roll by suitable screws 35. Their is a clearance between the bottom of the platen bar and the roll surface to allow for the insertion or removal of a shim 36 to adjust the platen bars to desired heights. The platen bars are spaced about the circumference of the roll complementary to the spacing of the cutting blades about the circumference of the top roll.

The rolls rotate in the direction of the arrows shown in FIG. 2 and are synchronized to rotate at exactly the same peripheral linear speed as measured at the steel bearers, the cutting edges and the platen bars. The rolls may also be synchronized to any previous process such as printing presses or rolls, rotary embossing mechanisms and the like.

In operation, a sheet of labels having substantially the same width as the distance between steel bearers is fed to the nip formed by the top roll and bottom roll as shown in FIGS. 3, 4 and 5. As the rolls rotate, each cutting edge 28 meets its corresponding platen bar 33 or anvil and places a clean slit in the sheet material at each cutting edge. The sponge rubber 29 wrapped about the top roll 17 prevents the light weight flimsy sheet material from waving or sagging between adjacent cutting edges on the same bar and between cutting edges on adjacent bars so that the accuracy may be maintained in placing slits in the sheet material. The steel bearers are accurately ground so that the cutting edge just meets the platen bar and the wear of the cutting edges is kept to a minimum. A very fine adjustment between the cutting edge and the platen bar may be accomplished by means of the shims placed beneath the platen bar in the bottom roll as previously described.

After considerable use, the cutting edges may become dull and not produce clean slits in the material.

At this time, the entire blade may be readily removed by removing the screws 27 and its appropriate holding wedge 26 and an entirely new cutting blade placed in the top roll.

Various changes may be made in the construction and certain features may be employed without otherwise departing from the invention or sacrificing ay of its advantages.

What is claimed is:

1. A rotary cutting mechanism for the register cutting of intermittent slits in flexible sheet material comprising: a first roll and a second roll mounted adjacent each other with their axes parallel, the first roll having a plurality of blades removably mounted at spaced intervals about the periphery of the roll, each of said blades being mounted parallel to the axis of said first roll and extending outwardly therefrom, each of said blades having a plurality of cutting edges at spaced intervals along the length of the blade and extending outwardly from the periphery of said first roll, resilient material mounted on the periphery of said first roll and extending between cutting edges on adjacent blades, said first roll having steel bearer members mounted at each end of the roll, said bearer members having the same diameter as the diameter of said first roll measured at the outer edge of the cutting edges, the second roll having a plurality of adjustable and removable platen bars mounted about the periphery of the second roll, each of said platen bars extending the length of the roll and being mounted parallel to the axis of said second roll, said platen bars being spaced apart the same distance as said blades on the first roll, said second roll having steel bearer members mounted at each end of said roll, said bearer members having the same diameter as the diameter of the second roll measured at the outer surface of said platen bars, said rolls rotating at the same peripheral linear speed and being positioned with respect to each other so that a cutting blade on said first roll comes into face-to-face relationship with a platen bar on said second roll at the nip formed by a pair of rolls.

2. A rotary cutting mechanism according to claim 1 wherein the resilient material is sponge rubber.

* * * * *